US009425005B2

(12) United States Patent
Gentsch

(10) Patent No.: US 9,425,005 B2
(45) Date of Patent: Aug. 23, 2016

(54) VACUUM INTERRUPTER WITH TRANSITION AREAS BETWEEN METAL HOUSING PARTS AND CERAMIC HOUSING PARTS COVERED BY INSULATING MATERIAL

(71) Applicant: ABB Technology AG, Zürich (CH)

(72) Inventor: Dietmar Gentsch, Ratingen (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 14/451,144

(22) Filed: Aug. 4, 2014

(65) Prior Publication Data

US 2014/0339195 A1 Nov. 20, 2014

Related U.S. Application Data

(63) Continuation of application No. PCT/EP2013/000282, filed on Jan. 31, 2013.

(30) Foreign Application Priority Data

Feb. 3, 2012 (EP) ..... 12000712

(51) Int. Cl.
*H01H 33/53* (2006.01)
*H01H 33/662* (2006.01)

(52) U.S. Cl.
CPC ..... *H01H 33/53* (2013.01); *H01H 33/66207* (2013.01); *H01H 2033/6623* (2013.01)

(58) Field of Classification Search
CPC ..... H01H 33/66; H01H 33/662
See application file for complete search history.

(56) References Cited

U.S. PATENT DOCUMENTS 3,626,125 A * 12/1971 Tonegawa ..... G01M 3/202 200/61.03
3,780,354 A * 12/1973 Sharp ..... H02B 13/02 218/140
3,814,882 A * 6/1974 Harrold ..... H01H 33/666 218/115
3,814,885 A * 6/1974 Sofianek ..... H01H 33/668 218/122
4,393,286 A * 7/1983 Takagi ..... H01H 33/66207 174/209
5,667,060 A 9/1997 Luzzi (Continued)

FOREIGN PATENT DOCUMENTS

DE 10 2008 031 473 B3 3/2010
EP 0 782 160 A2 7/1997

OTHER PUBLICATIONS

International Search Report (PCT/ISA/210) mailed on May 7, 2013, by the European Patent Office as the International Searching Authority for International Application No. PCT/EP2013/000282.

(Continued)

*Primary Examiner* — Truc Nguyen
(74) *Attorney, Agent, or Firm* — Taft Stettinius & Hollister LLP

(57) ABSTRACT

A vacuum interrupter is disclosed with transition areas between metal housing parts and ceramic housing parts covered by insulating material. To enhance dielectric performance and field grading behavior, the insulating material can extend as a tube or a multilayer tube design over at least nearly a complete length of the vacuum interrupter or vacuum device arrangement. The insulating material can be filled or at least covered at an inner surface which comes into close contact with the vacuum interrupter or vacuum device surface, with metal and/or conductive metal oxides.

13 Claims, 2 Drawing Sheets

(56) References Cited

U.S. PATENT DOCUMENTS 7,852,180 B2 * 12/2010 Gentsch ..... B29C 45/14639 218/118
2006/0231529 A1 * 10/2006 Daharsh ..... H01C 7/12 218/136
2007/0235415 A1 * 10/2007 Claus ..... H01H 33/66207 218/139
2008/0087647 A1 * 4/2008 Volkmar ..... H01H 33/66207 218/134
2008/0142485 A1 * 6/2008 Gentsch ..... B29C 45/14639 218/118
2013/0284704 A1 * 10/2013 Gentsch ..... H01H 33/666 218/140

OTHER PUBLICATIONS

Written Opinion (PCT/ISA/237) mailed on May 7, 2014, by the European Patent Office as the International Searching Authority for International Application No. PCT/EP2013/000282.

European Search Report mailed on Jul. 12, 2012, Application No. 12000712.5.

* cited by examiner

VACUUM INTERRUPTER WITH TRANSITION AREAS BETWEEN METAL HOUSING PARTS AND CERAMIC HOUSING PARTS COVERED BY INSULATING MATERIAL

RELATED APPLICATION(S)

This application claims priority as a continuation application under 35 U.S.C. §120 to PCT/EP2013/000282, which was filed as an International Application on Jan. 31, 2013 designating the U.S., and which claims priority to European Application 12000712.5 filed in Europe on Feb. 3, 2012. The entire contents of these applications are hereby incorporated by reference in their entireties.

FIELD

The present disclosure relates to a vacuum interrupter with transition areas between metal housing parts and ceramic housing parts covered by insulating material.

BACKGROUND INFORMATION

Vacuum interrupters are used with, for example, medium voltage switchgears. DE 10 2008 031 473 discloses a vacuum interrupter which has metal part sections and a ceramic section. In order to enhance a dielectric behaviour, the vacuum interrupter has rings of isolating material in regions of transition from a metal part to a ceramic part. This insulating ring material has additional additives inside the insulating material, such as metal oxides, in order to influence the insulating properties.

This construction is not efficient in, for example, series arranged multiple vacuum interrupters.

SUMMARY

A vacuum interrupter is disclosed comprising transition areas between metal housing parts and ceramic housing parts covered by insulating material, wherein the insulating material extends as a tube over at least nearly a complete length of the vacuum interrupter; and the insulating material being filled or at least covered at an inner surface which is closest with the vacuum interrupter housing parts, with metal and/or conductive metal oxides, or material with limited conductivity.

A method is disclosed for manufacturing a vacuum interrupter or vacuum device or a serial arrangement of multiple vacuum interrupters, the method comprising filling completely, or covering at an inner surface, an insulating material which is closest to the vacuum interrupter or vacuum device surface, with metal and/or conductive metal oxides and forming the insulating material as a tube of cold or warm shrinking insulating material; and placing the tube over at least nearly a complete length of the vacuum interrupter or device to form a covered vacuum interrupter/vacuum device or serial arranged multilayer vacuum interrupter or vacuum device arrangement.

BRIEF DESCRIPTION OF THE DRAWINGS

Features and advantages described herein will become apparent from the following detailed description of exemplary embodiments, when read in conjunction with the drawings, wherein.

DETAILED DESCRIPTION

Figure 1:
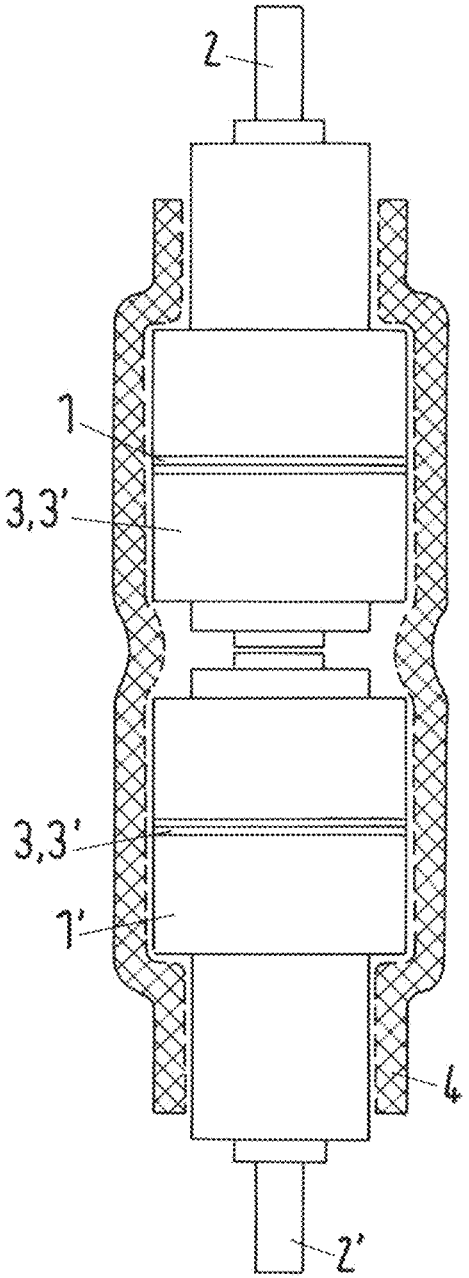
FIG. 1 shows an exemplary embodiment having an exemplary serial arrangement of two vacuum interrupters having a moveable stems, which vacuum interrupters are covered with one single common tube made of warm or cold shrink insulating material.

Exemplary embodiments are disclosed herein which can enhance dielectric performance and field grading behaviour of vacuum interrupters.

In an exemplary embodiment, a capacitor and resistor are included such that the steering of the voltage can be optimized (e.g., to achieve an enhanced dielectric performance of in series connected devices), such as in-series connected vacuum interrupters (VI), or in the case of a high voltage vacuum interrupter, all the shields can be connected to steer (i.e., for voltage grading) a graduated voltage distribution over the vacuum interrupter and/or, by having several VIs in series, a graduated voltage distribution inside a single vacuum interrupter and the overall distribution.

According to exemplary embodiments, an insulating material can extend as a tube over, for example, at least nearly a complete length of the vacuum interrupter, and the insulating material can be filled or at least covered at an inner surface which comes into close contact with the vacuum interrupter surface, with metal and/or conductive metal oxides or metal or material with limited conductivity.

The capacitor and/or the resistor can be installed in parallel to the devices and connected to terminals of each device. In case of a multigap shielded vacuum interrupter (e.g., a high voltage vacuum interrupter), the connection can be applied on several points to achieve a "good" voltage distribution of the arrangement. Taking into consideration the capacitors, and to a lesser extent, the resistors, the lifetime of this electrical field steering can be limited.

In a high voltage application vacuum interrupter, the insulation level of the device, by using several shieldings in one vacuum interrupter, or in the case of two or more installed vacuum interrupters in series connection, by applying a sheet material which has a limited conductivity, can be enhanced. In this case, a voltage distribution between the shieldings of one VI with a multi gap arrangement, or two or more vacuum interrupters, arranged in series, can be optimized to increase overall dielectric performance of the installed equipment.

An exemplary embodiment can include an arrangement of several vacuum interrupters or vacuum devices in series, wherein a common coverage by a common tube will be applied. This results in one common tube over nearly the complete axial extent of the vacuum interrupter or nearly the complete extent of a serial multiple vacuum interrupter arrangement. This tube can have much more dielectric enhancement effect, than an arrangement of locally extended rings, as already described in the background state of the art.

A further exemplary embodiment can include a ceramic part of the vacuum interrupter which is divided into a series arrangement of at least two ceramic segments, with externally extended middle shielding contacts between the segments, which can also be covered by the aforesaid common tube.

A further exemplary embodiment can include a ceramic part of the vacuum interrupter which is divided into a series arrangement of at least two ceramic segments, with externally extended middle shielding contacts between the segments, which can be also covered by a multilayer arrangement of some tubes.

A further exemplary embodiment can include a ceramic part of the vacuum interrupter which is divided into a series arrangement of at least two ceramic segments, with externally extended middle shielding (3, 3', 3") contacts between the segments, and a single tube of the multilayer arrangement can be electrically connected to the vacuum interrupter or device (as floatend), partially with some layer, or all the layers of the multilayer arrangement can be connected to the device.

In an exemplary embodiment, the tube can be a warm shrink tube, or as an exemplary alternative, a cold shrink tube. By using shrinking tubes or shrinking tube material as basic material, the tight placement of the tubes over the vacuum interrupter surface is easy achievable.

Furthermore, an exemplary vacuum interrupter or serial multi vacuum interrupter arrangement with the aforesaid common tube, can be embedded in epoxy resin, or a thermoplastic housing. This can result in complete pole parts with high dielectric performance.

As an exemplary alternative to an embedded pole part as already described, the vacuum interrupter or the serial multi vacuum interrupter arrangement with the aforesaid common tube can be assembled in a housing made of insulating material, as so called assembled pole parts.

An exemplary method for manufacture of a vacuum interrupter, or a pole part with a vacuum interrupter, is disclosed by which an insulating material can be filled completely or covered at an inner surface which comes into close contact with the vacuum interrupter surface, with metal and/or conductive metal oxides formed as a tube made of cold or warm shrinking insulating material, and the tube can be placed over at least nearly the complete length of the vacuum interrupter.

An exemplary embodiment can include the so covered vacuum interrupter or serial arranged multiple vacuum interrupter arrangement being placed into a moulding, and an insulating housing can be configured with epoxy resin, or via a thermoplastic injection process.

In exemplary embodiments, the metal oxides used can include, for example, ZnO, Bi2O3, Co3O4 and CoO.

A stress grading material can be applied to heat shrinkable terminations/tubes. This shrinkage tube can be applied especially to a multi vacuum interrupter arrangement and to a multi shielding of the vacuum interrupter. In an exemplary case, this shrinkage tube can be applied over both the vacuum interrupter having the grading/steering of the shieldings and the vacuum interrupter. After this application, the parts can be embedded in epoxy resin or a similar plastic material such as thermoplastic material.

FIG. 1 shows an exemplary serial arrangement of two vacuum interrupters 1, 1' having a moveable stem portions 2, 2', which vacuum interrupters are covered with one single common tube 4 made of warm or cold shrink insulating material. Metal oxides can be introduced in two alternative or cumulative processes.

The metal oxides can be spread into the complete tube material, so that they are present in the complete bulk of the tube.

A first exemplary embodiment is only to cover at least the inner tube surface with conductive metal oxides or metal or conductive material, so that they come into close contact with the vacuum interrupter 1, 1' outer surface in the metal part regions as well as in the ceramic part regions, especially in contact with the outer shielding contacts 3, 3' 3".

The so pre-manufactured vacuum interrupter 1, 1' arrangement can be further treated in a moulding process, in order to embed it into an insulating housing as an embedded pole part.

Figure 2:
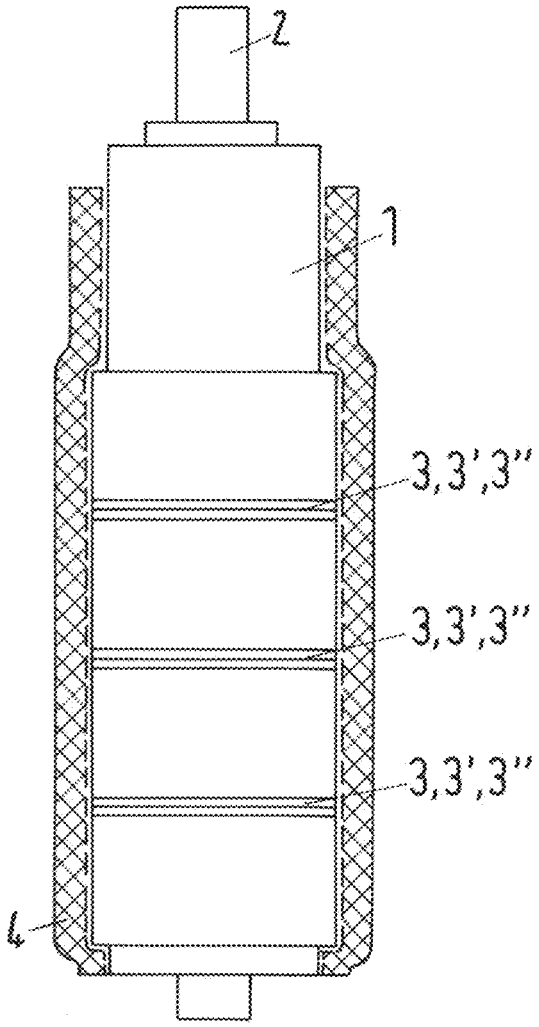
FIG. 2 shows an exemplary embodiment having an exemplary arrangement of a vacuum interrupter with multiple serial ceramic elements.

FIG. 2 shows an exemplary arrangement of a vacuum interrupter 1 with multiple serial ceramic elements. Between the ceramic elements are extended middle shielding contacts 3, 3', 3", so that they can come in electric contact with the tube 4. This conductive interconnection can result in a high dielectric performance with regard to a field coupling. Furthermore the tube can be applied as multiple tubes formed over each other as a multilayer arrangement.

Also, this exemplary FIG. 2 arrangement can be embedded into a further insulating housing by resin or injection moulding. Further layers can be designed as "floating" layers or connected partially or completely.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

POSITION NUMBERS

1, 1' vacuum interrupter
2, 2' stem, movable
3, 3' 3" middle shielding
4 tube

What is claimed is:

1. A vacuum interrupter having multiple serial ceramic elements comprising:

transition areas between metal housing parts and ceramic housing parts of the multiple serial ceramic elements covered by insulating material, wherein the insulating material extends as a common tube over at least nearly a complete length of the vacuum interrupter; and the insulating material is filled or at least covered at an inner surface which is closest to the vacuum interrupter housing parts, with metal and/or conductive metal oxides, or material with limited conductivity, wherein the common tube is a cold-shrink tube or a warm shrink tube.

2. The vacuum interrupter according to claim 1, wherein the ceramic housing part of the vacuum interrupter is divided into a series arrangement of at least two ceramic segments, with externally extended middle shielding contacts between the segments, which are covered by the common tube.

3. The vacuum interrupter according to claim 1, wherein the ceramic housing part of the vacuum interrupter is divided into a series arrangement of at least two ceramic segments, with externally extended middle shielding contacts between the segments, which are covered by a multilayer arrangement of insulating tubes.

4. The vacuum interrupter according to claim 1, wherein the ceramic housing part of the vacuum interrupter is divided into a series arrangement of at least two ceramic segments, with externally extended middle shielding contacts between the segments, and a single tube of the multilayer arrangement electrically connected to the vacuum interrupter partially via a layer of the multilayer arrangement, or via all layers of the multilayer arrangement.

5. The vacuum interrupter according to claim 1, wherein the vacuum interrupter or serial multi vacuum interrupter or vacuum device arrangement with the common tube is embedded in an epoxy resin, or thermoplastic housing.

6. The vacuum interrupter according to claim 1, wherein the vacuum interrupter or serial multi vacuum interrupter or vacuum device arrangement with the common tube is assembled in a housing made of insulating material.

7. A method for manufacturing a vacuum interrupter having multiple serial ceramic elements formed as a serial arrangement of multiple vacuum interrupters, the method comprising:

filling completely, or covering at an inner surface, an insulating material which is closest to the vacuum interrupter or vacuum device surface, with metal and/or conductive metal oxides and forming the insulating material as a tube of cold or warm shrinking insulating material; and placing the tube over at least nearly a complete length of the vacuum interrupter to form a covered serial arrangement of multiple vacuum interrupters.

8. The method according to claim 7, comprising:

placing the covered serial arrangement of multiple vacuum interrupters into a moulding to produce an insulating housing by epoxy resin, or a thermoplastic injection process.

9. The vacuum interrupter according to claim 1, wherein the ceramic housing part of the vacuum interrupter is divided into a series arrangement of at least two ceramic segments, with externally extended middle shielding contacts between the segments, which are covered by the common tube.

10. The vacuum interrupter according to claim 1, wherein the ceramic housing part of the vacuum interrupter is divided into a series arrangement at least two ceramic segments, with externally extended middle shielding contacts between the segments, which are covered by a multilayer arrangement of insulating tubes.

11. The vacuum interrupter according to claim 1, wherein the ceramic housing part of the vacuum interrupter is divided into a series arrangement of at least two ceramic segments, with externally extended middle shielding contacts between the segments, and a single tube of the multilayer arrangement electrically connected to the vacuum interrupter partially via a layer of the multilayer arrangement, or via all layers of the multilayer arrangement.

12. The vacuum interrupter according to claim 10, wherein the vacuum interrupter or serial multi vacuum interrupter or vacuum device arrangement with the common tube is embedded in an epoxy resin, or thermoplastic housing.

13. The vacuum interrupter according to claim 10, wherein the vacuum interrupter or serial multi vacuum interrupter or vacuum device arrangement with the common tube is assembled in a housing made of insulating material.

* * * * *